US006554331B2

(12) United States Patent
Ciborowski et al.

(10) Patent No.: US 6,554,331 B2
(45) Date of Patent: Apr. 29, 2003

(54) OUTSIDE DOOR HANDLE FOR A MOTOR VEHICLE

(75) Inventors: Robert E Ciborowski, Canton, MI (US); Paul R Stevenson, Livonia, MI (US); Marcus J Galli, White Lake, MI (US); David A Davies, Lake Orion, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 1 day.

(21) Appl. No.: 09/736,541

(22) Filed: Dec. 11, 2000

(65) Prior Publication Data

US 2002/0070567 A1 Jun. 13, 2002

(51) Int. Cl.[7] ..... E05B 1/00
(52) U.S. Cl. ..... 292/347; 292/336.3; 292/DIG. 22
(58) Field of Search ..... 292/336.3, 347, 292/DIG. 22, DIG. 65; 16/411, 412

(56) References Cited

U.S. PATENT DOCUMENTS

| | | | | | |
|---|---|---|---|---|---|
| 3,583,741 | A | * | 6/1971 | Breitschwerdt | 292/216 |
| 4,898,413 | A | * | 2/1990 | Bertolini | 292/336.3 |
| 5,632,516 | A | * | 5/1997 | Schwab | 292/336.3 |
| 6,007,122 | A | * | 12/1999 | Linder | 292/336.3 |
| 6,070,923 | A | * | 6/2000 | Tanimoto | 292/336.3 |
| 6,108,979 | A | | 8/2000 | Saffran et al. | 49/503 |

* cited by examiner

*Primary Examiner*—Gary Estremsky
(74) *Attorney, Agent, or Firm*—Ralph E. Smith

(57) ABSTRACT

A handle assembly for a motor vehicle door operative for selectively releasing a latch mechanism. The handle assembly includes a mounting portion attached to the motor vehicle door and a handle proper adapted to be manually grasped. The handle proper is translatable between a first position and a second position for releasing the latch mechanism. In a preferred form, the handle proper is biased to the first position by a coil spring.

9 Claims, 4 Drawing Sheets

OUTSIDE DOOR HANDLE FOR A MOTOR VEHICLE

BACKGROUND OF THE INVENTION

1. Field of the Invention

The present invention relates generally to articulating doors for motor vehicles, and more particularly to a handle for an articulating door of a motor vehicle.

2. Discussion

It is well known in the art of motor vehicle doors to provide a latch for latching the door in a closed position. It is also well known to provide a handle on the outside of the vehicle which is connected to the door latch by suitable linkages so that operating the handle will release the door latch to permit opening of the door. Such handles are typically comprised of a lever which is rotated, or a button which is pushed, in order to actuate the linkages. Conventional door handle assemblies, either of the push button type or pull out type, typically include a series of bell-cranks for converting the movement of the push button or the handle transversely of the vehicle door into movement to operate the vehicle door latch. For example, commonly assigned U.S. Pat. No. 6,108,979, discloses a handle proper which is linearly translatable between a first position and a second position for releasing a latch mechanism. U.S. Pat. No. 6,108,979 is hereby incorporated by reference as is fully set forth herein.

While known door handle assemblies have proven to be acceptable for their intended purposes, it remains desirable in the pertinent art to provide a door handle arrangement incorporating a latching mechanism including a rotating element that cooperates with the door handle to resist independent rotation.

SUMMARY OF THE INVENTION

It is a general object of the present invention to provide a vehicle door handle that efficiently incorporates a handle and latch release mechanism including a rotatable element configured to resist independent rotation thereof.

In one form, the present invention provides a handle assembly for selectively releasing a latch mechanism of a vehicle door. The vehicle door is mounted to a vehicle body for pivotal movement about an axis of rotation. The handle assembly includes a mounting portion attached to the vehicle door. The handle assembly further includes a handle proper operatively interconnected with the mounting portion and the latch mechanism. The handle proper includes a first end attached to the mounting portion (defining a pivot axis and a second end rotatable about the pivot axis from a first position to a second position for releasing the latch mechanism.

In another form, the present invention provides a handle having an arm and latch mechanism including a rotatable element. The rotatable element cooperates with the arm of the handle such that when the handle remains stationary and the rotatable element rotates, the rotatable element abuts the arm of the handle thereby preventing actuation of the latch.

In yet another form, the present invention provides a door assembly for mounting to a body of a motor vehicle for pivotal movement about an axis of rotation between an opened position and a closed position. The door assembly includes the door frame and a latch mechanism for selectively interconnecting a portion of the door frame with the body. The door assembly further includes a handle assembly attached to the door frame and interconnected with the latch mechanism. The handle assembly includes a manually controlled element displaceable from a first position to a second position for releasing the latch mechanism.

BRIEF DESCRIPTION OF THE DRAWINGS

Additional objects and advantages of the present invention will become apparent from a reading of the following detailed description of the preferred embodiment which makes reference to the drawings of which.

DETAILED DESCRIPTION OF THE PREFERRED EMBODIMENT

Figure 1:
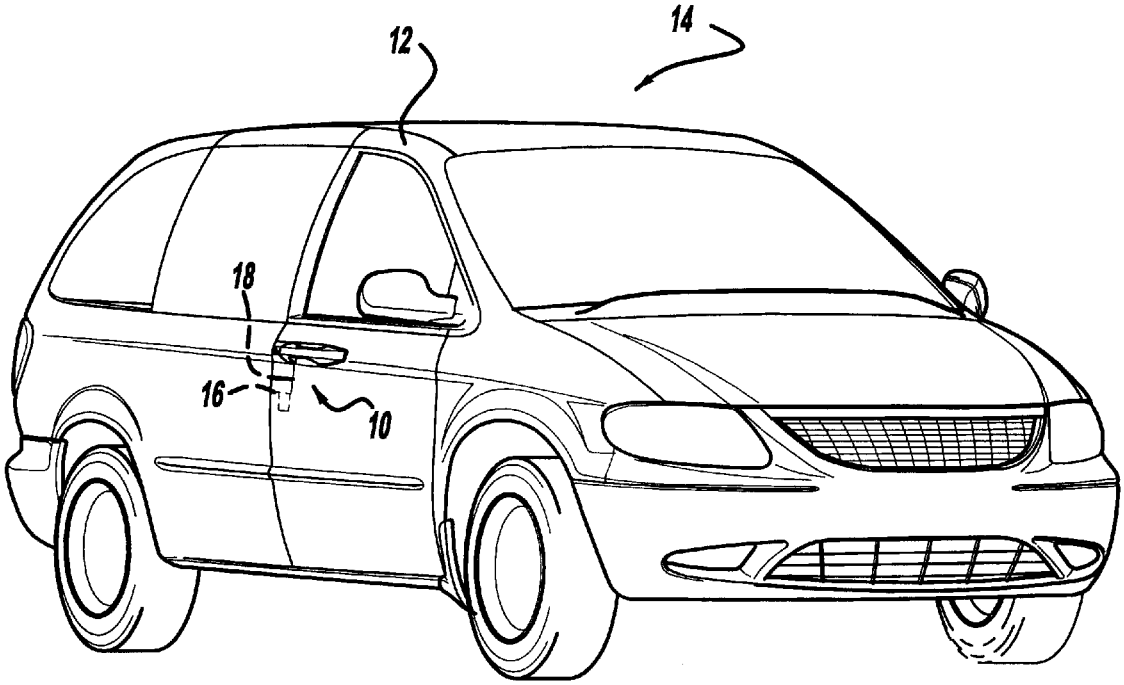
FIG. 1 is an environmental view of a handle assembly constructed in accordance with a preferred embodiment of the present invention shown incorporated into a passenger door of a motor vehicle.
Figure 2:
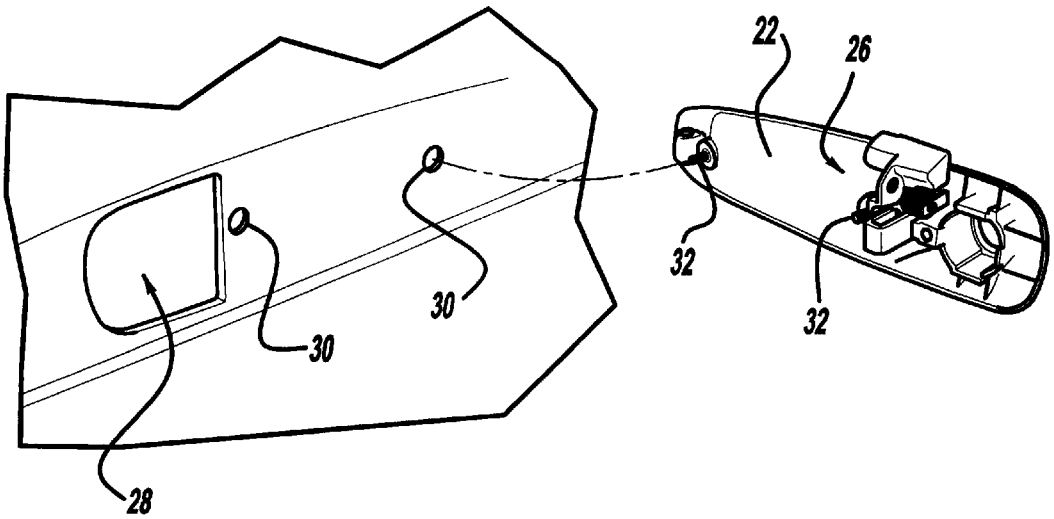
FIG. 2 is a partially exploded view of the handle assembly of the present invention.
Figure 3:
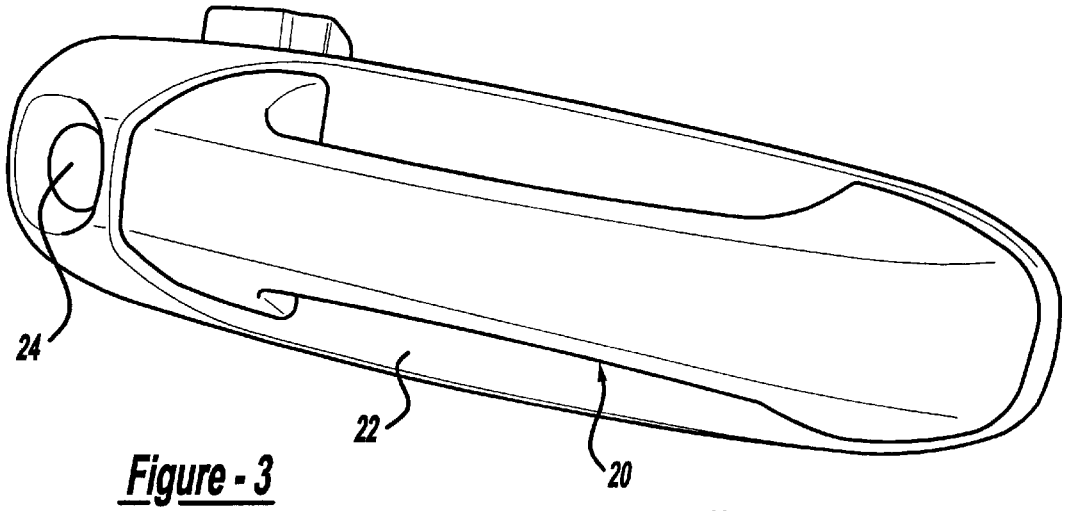
FIG. 3 is a front perspective view of the handle assembly of the present invention.
Figure 4:
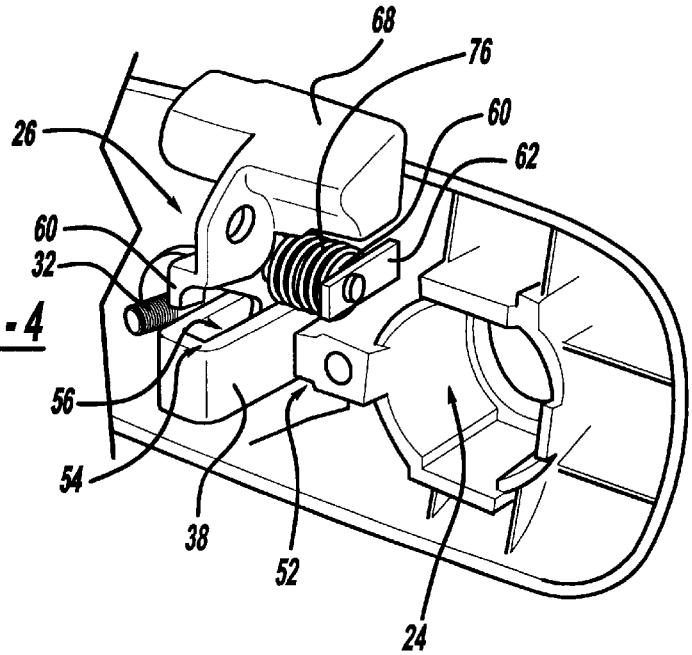
FIG. 4 is a rear perspective view of the handle assembly of the present invention.

With initial reference to FIG. 1, a handle assembly constructed in accordance with the preferred embodiment of the present invention is shown operatively associated with a handle assembly 10 of vehicle door 12. The vehicle door 12 shown is a passenger door for a minivan, sport utility or other vehicle 14, which is otherwise of conventional construction. The particular vehicle door 12 illustrated should be considered exemplary, as the teachings of the present invention are applicable for virtually any type of vehicle door.

Prior to addressing the construction and operation of the handle assembly 10 of the present invention, a brief understanding of the exemplary vehicle door 12 is warranted. While not specifically shown, it will be understood that the vehicle door 12 is mounted to the body of the vehicle 14 for pivotal movement about a vertical axis adjacent the front side of the door 12. The vehicle door 12 is movable between an open position (not shown) and a closed position (shown in FIG. 1). The handle assembly 10 is interconnected with a latching mechanism 16 through a cable 18. The latching mechanism 16 is of conventional construction and operates to release a striker (not shown) carried by the vehicle body when activated to permit movement of the vehicle door 12 from its closed position.

Turning now to FIGS. 2–8, the handle assembly of the present invention 10 will be described in detail. The handle assembly 10 is shown to generally include a handle proper 20, a base 22, a key lock housing 24 and a control linkage 26 interconnecting the handle proper 20 with the cable 18. As shown most specifically in FIGS. 2 and 4, the handle assembly 10 is mounted through a pair of apertures 30 provided in the vehicle door 12. Cutaway section 28 accommodates the rotating action of the control linkage 26. The base 22 includes a pair of rearwardly extending locating members 32 adapted to pass through apertures 30 and engage fasteners (not shown) in a conventional manner.

Figure 5:
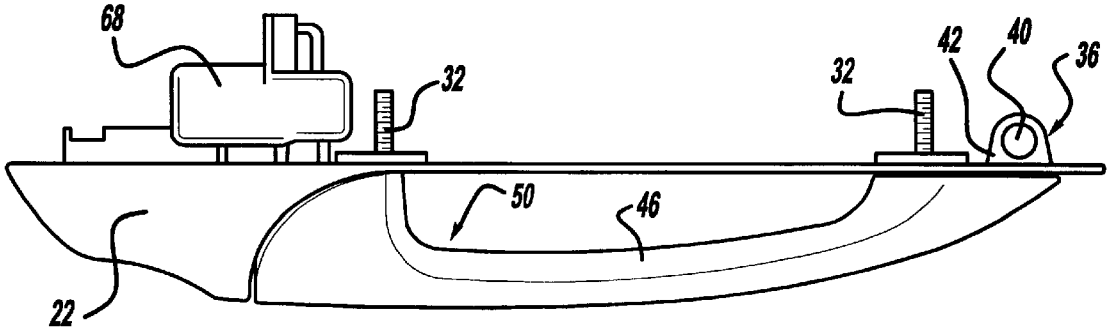
FIG. 5 is a top view of the handle assembly of the present invention.

The handle proper 20 is shown to include an elongated gripping portion 46, a first end interconnected to a pivot joint 36 and a second end having an arm 38 adapted to cooperate with control linkage 26. Pivot joint 36 includes a pin 40 locating an arm of the handle proper (not shown) to a joint housing 42 of base 22. A longitudinal axis of the gripping portion 46 is disposed generally horizontally and thus perpendicular to the axis of door rotation. As seen in FIG. 5, the gripping portion 46 is slightly curved in top view, thereby providing comfort to the user and thereby contributing to an aesthetically pleasing vehicle appearance. An area 50 for receiving the operator's fingers is defined between the griping portion 46 and the base 22.

Figure 6:
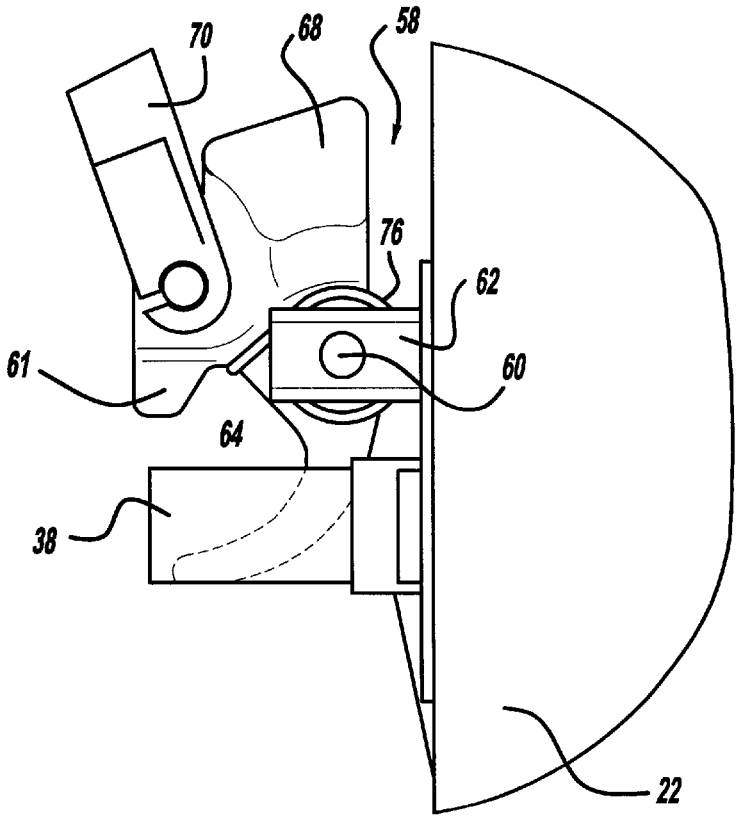
FIG. 6 is a side view of the handle assembly of the present invention illustrated in a latched position.
Figure 7:
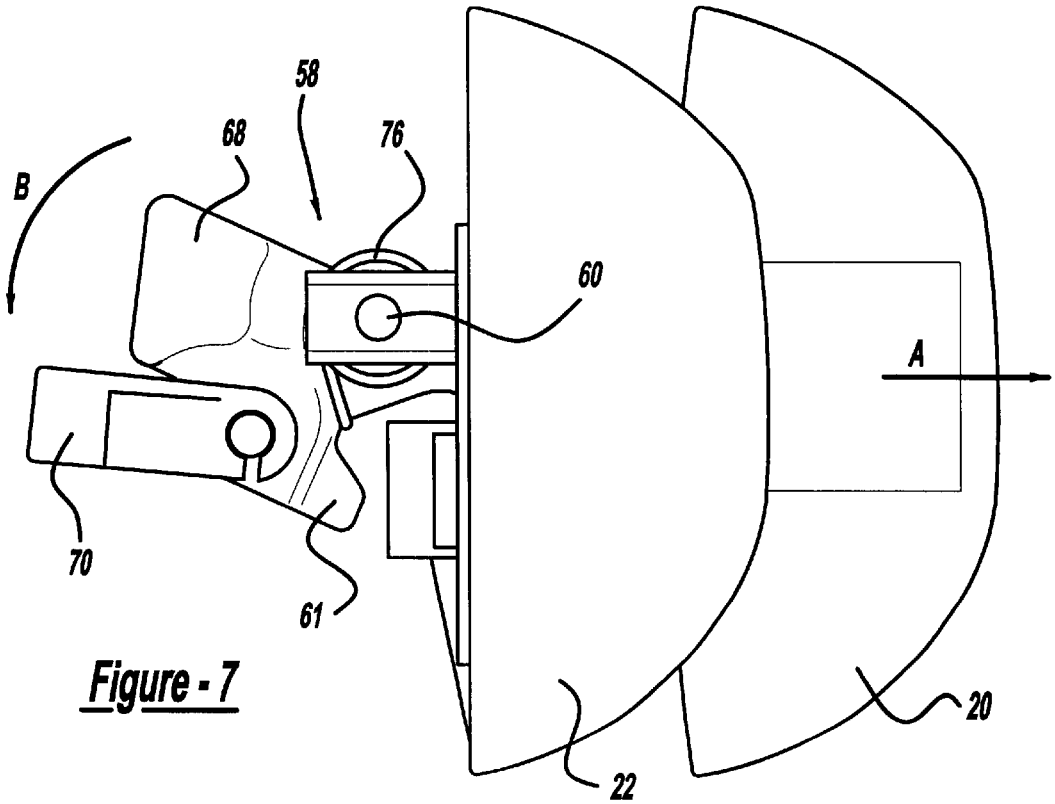
FIG. 7 is a side view of the handle assembly of the present invention illustrated in a unlatched position.

The arm 38 of the handle proper 20 is linearly translatable within channel 52 defined by the base 22. That is, the second end of handle proper 20 is pivotally movable between a first position (as shown in FIG. 6) in which the latching mechanism 16 is closed and a second position (as shown in FIG. 7) in which the latching mechanism is open. The direction of movement of the second end of handle proper 20 is identified in FIG. 7 with arrow A. As will become more apparent below, the rearwardly extending arm 38 of the handle proper 20 is formed to include recess 56 passing vertically therethrough for cooperating with the control linkage 26.

The control linkage 26 is mounted for pivotal movement about an axis substantially parallel to the longitudinal axis of the gripping portion 46 of the handle proper 20. A pivot axis for control linkage 26 is defined by an elongated pivot rod 60 passing through apertures formed in first and second (not shown) mounting flanges 62.

As shown more specifically in FIG. 6, control linkage 26 is further shown to include a bell crank assembly 58 having leg 64, counterweight 68 and pawl 61. Leg 64 is adapted to be located through recess 56 of arm 38 of handle proper 20. The control linkage 26 is shown to further include a connecting portion 70 for connecting the control linkage 26 with the cable 18. This construction in other arrangements may be to a rod or other suitable latch actuating means.

The handle assembly 10 of the present invention is further shown to include a biasing member 76 for biasing the handle assembly 10 to its first position and thereby the latching mechanism 16 to its closed position as shown in FIG. 6. In the embodiment illustrated, the biasing mechanism is a coil spring 76 which surrounds the pivot rod 60. The coil spring functions to bias the bell-crank assembly 58 in a clockwise direction (as shown in FIG. 6 and FIG. 7).

The operation of the handle assembly 10 may now be understood referring generally to FIGS. 1–7 and specifically to FIGS. 6 and 7. As the second end of handle proper 20 is moved from its first position (as shown, for example, in FIGS. 5 and 6) to its second position (as shown in FIG. 7) the rearwardly extending leg 38, and hence leg 64 carried in slot 56, retracts, thereby overcoming the biasing force of the coil spring 76 on bell crank assembly 58 and causing control linkage 26 to rotate counter-clockwise (Direction B). The leg 64 of control linkage 26 provides a mechanical advantage for operating the latch mechanism 16. The rotational movement of the control linkage 26 is converted to linear motion through the cable 18 which serves to release the latching mechanism 16. When the handle proper 20 is released, the biasing force of the coil spring 76 returns the second end of the handle proper 20 to its first position and thereby returns the latching mechanism 16 to its closed position.

Figure 8:
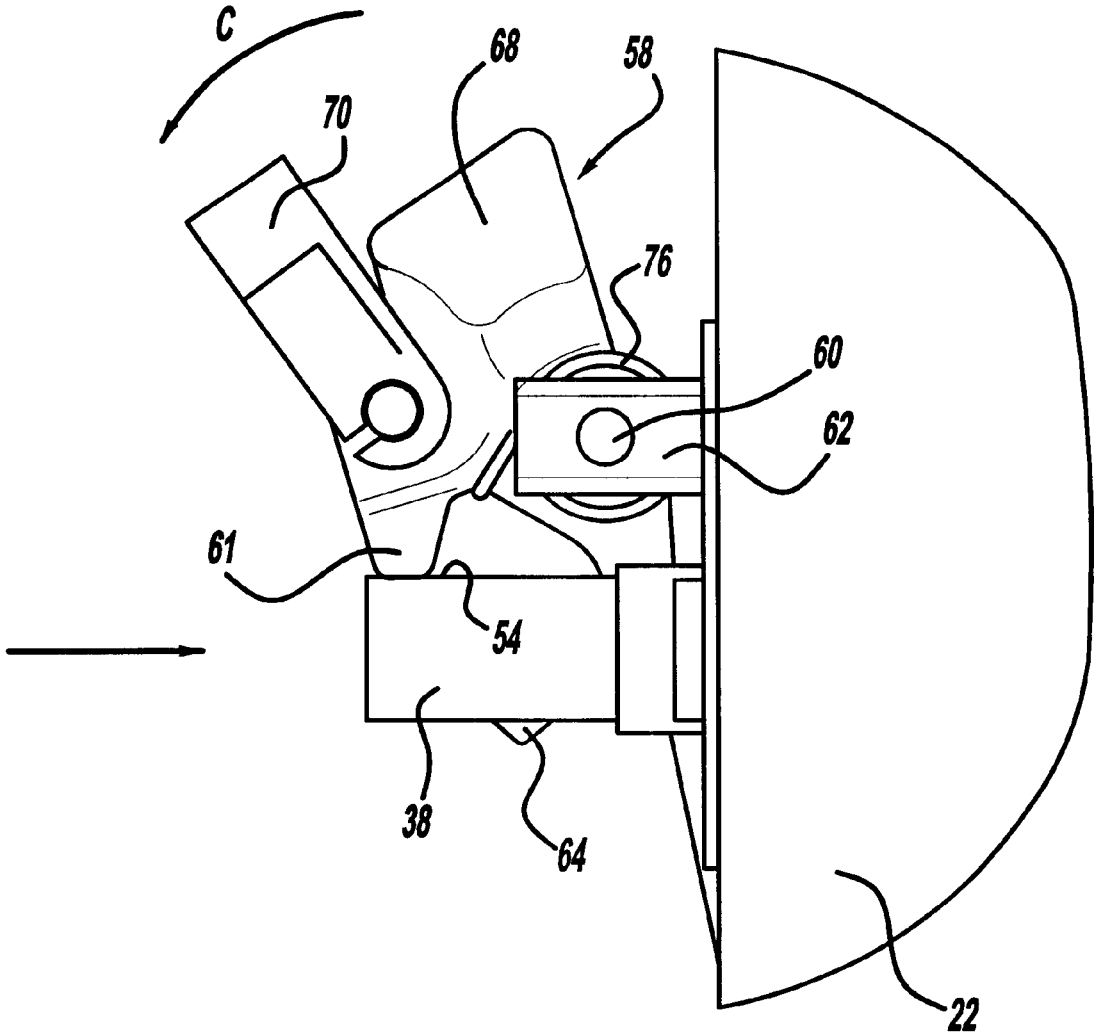
FIG. 8 is a side view of the handle assembly resisting rotation of the rotatable element as the handle remains stationary.

Turning now to FIG. 8, the operation of the counterbalance 68 and pawl 61 will now be described. In the exemplary illustrations, the handle is shown disposed in a passenger side door 12. In the event counterweight 68 overcomes the bias of spring 76 and rotates in a counter-clockwise direction (arrow C), pawl 60 will abut against upper surface 54 of arm 38 thereby preventing further rotation. It can be appreciated that this configuration is adaptable to any side of a vehicle to resist rotation of the rotatable element.

While the above description constitutes the preferred embodiment of the invention, it will be appreciated that the invention is susceptible to modification, variation, and change without departing from the proper scope or fair meaning of the accompanying claims. For example, it will be understood that the handle proper 20 may be mounted to the vehicle door 12 such that it is oriented in a generally vertical manner. Such an arrangement may be particularly desirable for vehicle doors mounted for pivotal movement about a vertical axis.

What is claimed is:

1. A handle assembly for selectively releasing a latch mechanism of a vehicle door, the vehicle door mounted to a vehicle body for pivotal movement about an axis of rotation, the handle assembly comprising:

a base adapted to be attached to the vehicle door;

a rotatable element including a first end defining a leg, a second end defining a counterweight and an intermediate portion having a pawi, the rotatable element pivotally attached to the base and rotatable from a first position to a second position for releasing the latch mechanism; and a handle proper operatively interconnected with the rotatable element, the handle proper having a first end mounted to the base section defining a pivot axis and a second end operatively interconnected via an arm with the rotatable element such that pivotal movement of the second end of the handle about the pivot axis causes the rotatable element to rotate from its first position to its second position so as to release the latch mechanism;

wherein when the rotatable element rotates and the handle remains stationary, the pawl abuts the arm of the handle thereby preventing the latch mechanism from releasing.

2. The handle assembly for selectively releasing a latch mechanism of a vehicle door of claim 1, wherein the arm has a recess for receiving the leg of the rotatable element.

3. The handle assembly for selectively releasing a latch mechanism of a vehicle door of claim 2, further comprising a biasing member for biasing the rotatable element to its first position.

4. The handle assembly for selectively releasing a latch mechanism of a vehicle door of claim 3, wherein the biasing member includes a coil spring acting upon the rotatable element.

5. The handle assembly for selectively releasing a latch mechanism of a vehicle door of claim 1, wherein the counterweight is oriented to rotate thereby influencing the pawl against the arm of the handle preventing release of the latch mechanism.

6. A handle assembly for selectively releasing a latch mechanism of a vehicle door, the vehicle door mounted to a vehicle body for pivotal movement about an axis of rotation, the handle assembly comprising:

a base adapted to be attached to the vehicle door;

a rotatable element pivotally attached to the base and including a leg, a pawl and a counterweight, the rotatable element rotatable about an axis of rotation from a first position to a second position for releasing the latch mechanism; and a handle proper having a first end attached to the base defining a pivot axis and a second end including an arm having a recess receiving the leg of the rotatable element, the arm of the handle proper being movable with pivotal movement of the second end of the handle proper to move the leg of the rotatable element to cause the rotatable element to rotate from its first position to its second position so as to release the latch mechanism.

7. The handle assembly for selectively releasing a latch mechanism for a vehicle door of claim 6, wherein when the rotatable element rotates and the handle remains stationary, the pawl abuts the arm of the handle thereby preventing the latch mechanism from releasing.

8. The handle assembly for selectively releasing a latch mechanism of a vehicle door of claim 6, further comprising a biasing member for biasing the rotatable element to its first position.

9. The handle assembly for selectively releasing a latch mechanism of a vehicle door of claim 8, wherein the biasing member includes a coil spring acting upon the rotatable element.

* * * * *